US011283156B2

(12) United States Patent
Jeon et al.

(10) Patent No.: US 11,283,156 B2
(45) Date of Patent: Mar. 22, 2022

(54) ANTENNA AND ELECTRONIC DEVICE INCLUDING CONDUCTIVE MEMBER ADJACENT TO THE ANTENNA

(71) Applicant: Samsung Electronics Co., Ltd., Gyeonggi-do (KR)

(72) Inventors: Seunggil Jeon, Gyeonggi-do (KR); Namwoo Kim, Gyeonggi-do (KR); Seongbeom Hong, Gyeonggi-do (KR); Kyunghoon Moon, Gyeonggi-do (KR); Yunbum Lee, Gyeonggi-do (KR)

(73) Assignee: Samsung Electronics Co., Ltd

( * ) Notice: Subject to any disclaimer, the term of this patent is extended or adjusted under 35 U.S.C. 154(b) by 0 days.

(21) Appl. No.: 16/788,925

(22) Filed: Feb. 12, 2020

(65) Prior Publication Data

US 2020/0259243 A1 Aug. 13, 2020

(30) Foreign Application Priority Data

Feb. 12, 2019 (KR) ..... 10-2019-0015885

(51) Int. Cl.
*H01Q 1/24* (2006.01)

(52) U.S. Cl.
CPC ..... *H01Q 1/243* (2013.01)

(58) Field of Classification Search
CPC ..... H01Q 1/24; H01Q 1/243; H01Q 5/307; H01Q 9/0407; H01Q 1/2283; H01Q 1/2291; H01Q 1/38; H01Q 21/29; H01Q 21/293
See application file for complete search history.

(56) References Cited

U.S. PATENT DOCUMENTS

| | | | | |
|---|---|---|---|---|
| 8,610,629 | B2 | 12/2013 | Pascolini et al. | |
| 2007/0046465 | A1 | 3/2007 | Sakama et al. | |
| 2010/0117916 | A1 | 5/2010 | Gustafsson et al. | |
| 2012/0050123 | A1* | 3/2012 | Wang | H01Q 13/10 343/767 |
| 2013/0210372 | A1 | 8/2013 | Park et al. | |
| 2016/0197396 | A1* | 7/2016 | Choi | H01Q 1/48 343/702 |

(Continued)

FOREIGN PATENT DOCUMENTS

| | | |
|---|---|---|
| KR | 1020100015387 | 2/2010 |
| KR | 1020180031120 | 3/2018 |

(Continued)

OTHER PUBLICATIONS

International Search Report dated Apr. 9, 2020 issued in counterpart application No. PCT/KR2019/018452, 3 pages.

*Primary Examiner* — Thai Pham
(74) *Attorney, Agent, or Firm* — The Farrell Law Firm, P.C.

(57) ABSTRACT

Disclosed is an electronic device including a housing including a first plate facing a first direction, a second plate facing a second direction opposite to the first direction, and a lateral member surrounding a space between the first plate and the second plate, a first antenna structure disposed to be substantially parallel with the second plate in the space, and including a substrate disposed in the space, and at least one antenna element disposed on the substrate to face at least the second plate, a conductive member disposed in the space and spaced apart from the at least one antenna element by a predetermined interval when the second plate is viewed from above.

10 Claims, 13 Drawing Sheets

(56) References Cited

U.S. PATENT DOCUMENTS

| | | | | |
|---|---|---|---|---|
| 2017/0149118 | A1 | 5/2017 | Wang et al. | |
| 2017/0201014 | A1* | 7/2017 | Lee | H01Q 15/02 |
| 2018/0090821 | A1 | 3/2018 | Lee et al. | |
| 2018/0241115 | A1* | 8/2018 | Cho | H04M 1/0266 |
| 2018/0269568 | A1* | 9/2018 | Xu | H01Q 1/243 |
| 2019/0006751 | A1 | 1/2019 | Chen et al. | |
| 2019/0221941 | A1 | 7/2019 | Liu et al. | |
| 2020/0028241 | A1 | 1/2020 | Jung et al. | |
| 2020/0144698 | A1* | 5/2020 | Seo | H01Q 21/08 |
| 2020/0144703 | A1* | 5/2020 | Ahn | H01Q 1/28 |

FOREIGN PATENT DOCUMENTS

| | | |
|---|---|---|
| KR | 1020180035605 | 4/2018 |
| KR | 1020190001741 | 1/2019 |
| WO | WO 2018/006260 | 1/2018 |

* cited by examiner

| Name | Theta | Ang | Mag |
|---|---|---|---|
| m1 | 172.0000 | 172.0000 | 11.4977 |
| m2 | 212.0000 | -148.0000 | 8.0124 |
| m3 | 152.0000 | 152.0000 | 8.2199 |
| m4 | 184.0000 | -175.0000 | 11.2926 |
| m5 | 202.0000 | -158.0000 | 8.1956 |
| m6 | 158.0000 | 158.0000 | 8.6866 |

| Name | Delta(Theta) | Delta(Ang) | Delta(... |
|---|---|---|---|
| d(m2,m3) | -60.0000 | 300.0000 | 0.2075 |
| d(m5,m6) | -44.0000 | 316.0000 | 0.4910 |

ANTENNA AND ELECTRONIC DEVICE INCLUDING CONDUCTIVE MEMBER ADJACENT TO THE ANTENNA

CROSS-REFERENCE TO RELATED APPLICATION(S)

This application is based on and claims priority under 35 U.S.C. § 119 to Korean Patent Application No. 10-2019-0015885, filed on Feb. 12, 2019, in the Korean Intellectual Property Office, the entire disclosure of which is incorporated herein by reference.

BACKGROUND

1. Field

The disclosure relates generally to an electronic device, and more particularly, to an antenna and an electronic device including a conductive member disposed near the antenna.

2. Description of Related Art

With the development of wireless communication technology, communication electronic devices are commonly used in daily life, thereby exponentially increasing the use of contents. Accordingly, a network capacity limit may be nearing exhaustion. After commercialization of 4th generation (4G) communication systems, in order to meet growing wireless data traffic demand, a communication system (e.g., 5th generation (5G), pre-5G communication system, or new radio (NR)) that transmits and/or receives signals using a frequency of a high frequency (e.g., millimeter wave (mm-Wave)) band (e.g., 3 gigahertz (GHz) to 300 GHz band) is being developed.

Next-generation wireless communication technologies are currently being developed to permit signal transmission/reception using frequencies in the range of 3 GHz to 100 GHz, to overcome a high free space loss due to frequency characteristics, to implement an efficient mounting structure for increasing an antenna gain, and to realize a related new antenna including an array-type antenna structure in which various numbers of antenna elements are arranged at regular intervals. The antenna structure may form a beam pattern on a planar-type printed circuit board through a cover plate (e.g., a rear plate) provided as a part of a housing for protecting internal electronic components of the electronic device and forming the appearance of the device. The cover plate may be formed of coated or colored glass, ceramic, polymer, or any combination thereof. Between the antenna structure and an external space of the electronic device may be interposed not only the cover plate, but also internal structures of the electronic device such as a double-sided tape member, a bracket, and a waterproof member.

The beam pattern of the antenna structure is formed through the cover plate and/or the internal structures, each of which having a specific dielectric constant. This cause a problem of radiation performance degrading of the antenna structure. For example, the beam pattern of the antenna structure should have a half power beam width (HPBW) being wide in a direction orthogonal to the increasing direction of the antenna elements.

However, the beam pattern may be at least partially distorted or may cause a null occurrence by surrounding dielectrics, resulting in degrading of the radiation performance.

As such, there is a need in the art for a method and an apparatus for preventing such radiation performance degradation in the electronic device incorporating this antenna structure.

SUMMARY

Aspects of the present disclosure are to address at least the above mentioned problems and/or disadvantages and to provide at least the advantages described below.

Accordingly, an aspect of the present disclosure is to provide an antenna and an electronic device including a conductive member adjacent to the antenna.

Another aspect of the disclosure is to provide an antenna configured to prevent degradation of radiation performance due to various internal structures of an electronic device each having a specific dielectric constant, and also provide the electronic device including a conductive member disposed around the antenna.

In accordance with an aspect of the disclosure, an electronic device may include a housing including a first plate facing a first direction, a second plate facing a second direction opposite to the first direction, and a lateral member surrounding a space between the first plate and the second plate, a first antenna structure disposed to be substantially parallel with the second plate in the space, and including a substrate disposed in the space, and at least one antenna element disposed on the substrate to face at least the second plate, a conductive member disposed in the space and spaced apart from the at least one antenna element by a predetermined interval when the second plate is viewed from above.

BRIEF DESCRIPTION OF THE DRAWINGS

The above and other aspects, features and advantages of certain embodiments of the disclosure will be more apparent from the following detailed description, taken in conjunction with the accompanying drawings, in which.

DETAILED DESCRIPTION

Figure 1:
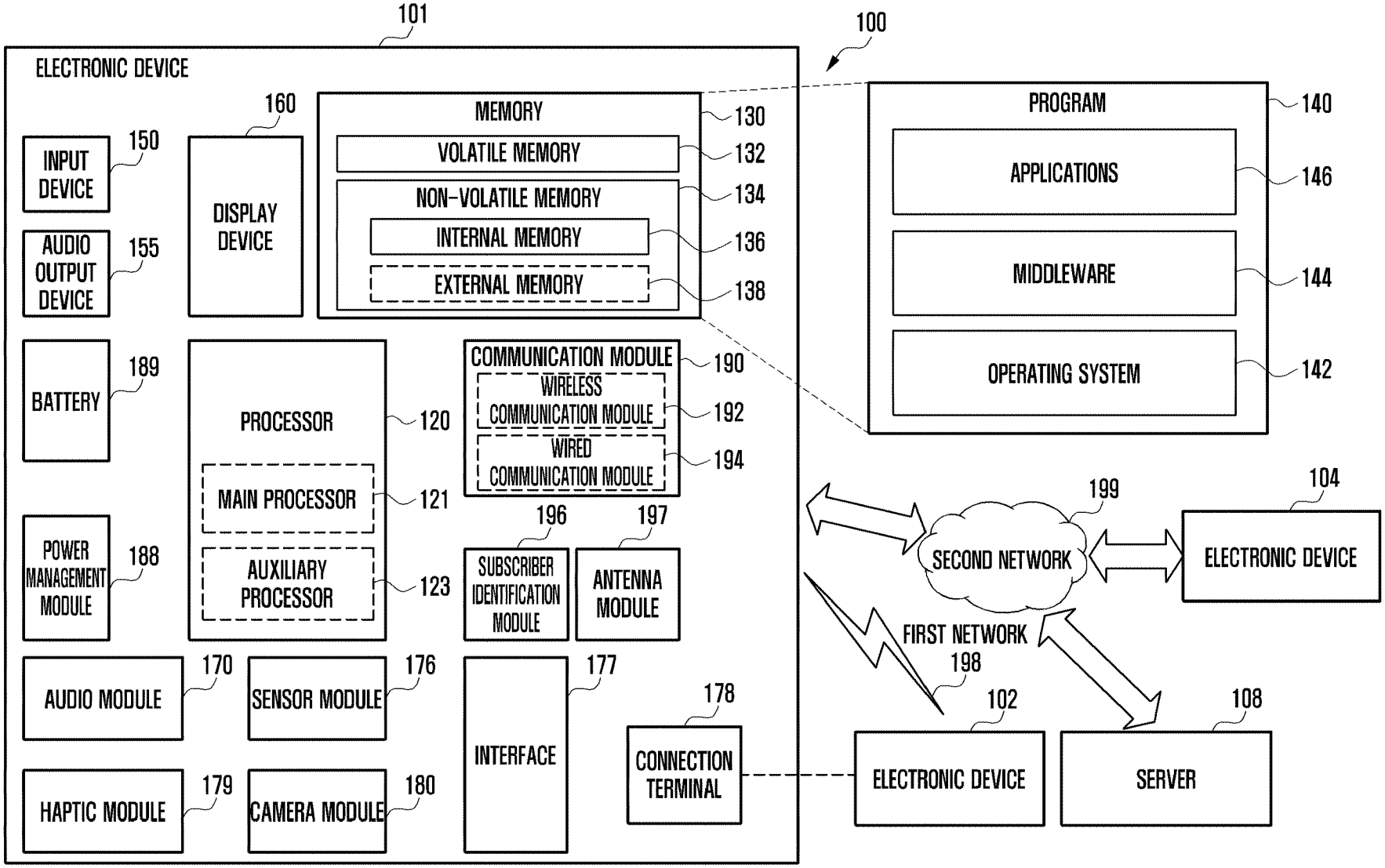
FIG. 1 illustrates a configuration of an electronic device in a network environment according to an embodiment.

Embodiments will be described in detail in conjunction with the accompanying drawings. Descriptions of well-known functions and constructions are omitted for the sake of clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure.

Singular terms "a," "an," and "the" include plural referents unless the context clearly dictates otherwise. Thus, reference to "a component surface" includes reference to one or more of such surfaces.

With regard to the description of the drawings, similar reference numerals may be used to refer to similar or related elements.

As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases.

As used herein, such terms as "1st" and "2nd", or "first" and "second" may be used to distinguish a corresponding component from another, and does not limit the components in another aspect, such as importance or order. If an element, such as a first element, is referred to, with or without the term "operatively" or "communicatively", as "coupled with", "coupled to", "connected with", or "connected to" another element, such as a second element, this indicates that the first element may be coupled with the second element directly (e.g., wiredly), wirelessly, or via a third element.

FIG. 1 illustrates an electronic device in a network environment according to an embodiment.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). The electronic device 101 may communicate with the electronic device 104 via the server 108. (not shown) The electronic device 101 includes a processor 120, memory 130, an input device 150, an audio output device 155, a display device 160, an audio module 170, a sensor module 176, an interface 177, a haptic module 179, a camera module 180, a power management module 188, a battery 189, a communication module 190, a subscriber identification module (SIM) 196, and an antenna module 197. At least one of the components may be omitted from the electronic device 101, or one or more other components may be added in the electronic device 101. Some of the components may be implemented as single integrated circuitry. For example, the sensor module 176 may be implemented as embedded in the display device 160.

The processor 120 may execute a program 140 to control at least one other hardware or software component of the electronic device 101 coupled with the processor 120, and may perform various data processing or computation. As at least part of the data processing or computation, the processor 120 may load a command or data received from another component in volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component among the components of the electronic device 101, instead of the main processor 121 while the main processor 121 is in an inactive (e.g., sleep) state, or together with the main processor 121 while the main processor 121 is in an active state. The auxiliary processor 123 (e.g., an image signal processor (ISP) or a CP) may be implemented as part of another component (e.g., the camera module 180 or the communication module 190) functionally related to the auxiliary processor 123.

The memory 130 may store various data used by at least one component of the electronic device 101, such as the program 140 and input data or output data for a command related thereto. The memory 130 may include the volatile memory 132 or the non-volatile memory 134.

The program 140 may be stored in the memory 130 as software and may include an operating system (OS) 142, middleware 144, and applications 146.

The input device 150 may receive a command or data to be used by the processor 120 of the electronic device 101, from the outside (e.g., a user) of the electronic device 101. The input device 150 may include a microphone, a mouse, a keyboard, or a digital pen.

The audio output device 155 may output sound signals to the outside of the electronic device 101 and may include a speaker or a receiver. The speaker may be used for general purposes, such as playing multimedia or playing record, and the receiver may be used for receiving incoming calls. The receiver may be implemented as separate from, or as part of the speaker.

The display device 160 may visually provide information to the outside (e.g., a user) of the electronic device 101. The display device 160 may include a display, a hologram device, or a projector and control circuitry to control a corresponding one of the display, hologram device, and projector. The display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. The audio module 170 may obtain the sound via the input device 150, or output the sound via the audio output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. The sensor module 176 may include a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, and an illuminance sensor.

The interface 177 may support one or more specified protocols to be used for the electronic device 101 to be coupled with the external electronic device 102 directly (e.g., wiredly) or wirelessly. The interface 177 may include a high definition multimedia interface (HDMI), a universal serial bus (USB) interface, a secure digital (SD) card interface, or an audio interface.

A connection terminal 178 may include a connector via which the electronic device 101 may be physically connected with the external electronic device 102. The connection terminal 178 may include an HDMI connector, a USB connector, an SD card connector, or an audio connector.

The haptic module 179 may convert an electrical signal into a mechanical stimulus (e.g., a vibration or a movement) or electrical stimulus which may be recognized by a user via his tactile sensation or kinesthetic sensation. The haptic module 179 may include a motor, a piezoelectric element, or an electric stimulator.

The camera module 180 may capture a still image or moving images. The camera module 180 may include one or more lenses, image sensors, image signal processors, or flashes.

The power management module 188 may manage power supplied to the electronic device 101. The power management module 188 may be implemented as at least part of a power management integrated circuit (PMIC).

The battery 189 may supply power to at least one component of the electronic device 101 and may include a primary cell which is not rechargeable, a secondary cell which is rechargeable, or a fuel cell.

The communication module 190 may support establishing a direct communication channel or a wireless communication channel between the electronic device 101 and the external electronic device and performing communication via the established communication channel. The communication module 190 may include one or more communication processors that are operable independently from the processor 120 (e.g., the AP) and supports a direct communication or a wireless communication. The communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, Wi-Fi direct, or infrared data association (IrDA)) or the second network 199 (e.g., a long-range communication network, such as a cellular network, the Internet, or a computer network (e.g., LAN or wide area network (WAN)).

These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., an international mobile subscriber identity (IMSI)) stored in the SIM 196.

The antenna module 197 may transmit or receive a signal or power to or from the external electronic device. The antenna module 197 may include an antenna including a radiating element composed of a conductive material or a conductive pattern formed in or on a substrate (e.g., a printed circuit board (PCB)). The antenna module 197 may include a plurality of antennas. In such a case, at least one antenna appropriate for a communication scheme used in the communication network, such as the first network 198 or the second network 199, may be selected by the communication module 190 from the plurality of antennas. The signal or the power may then be transmitted or received between the communication module 190 and the external electronic device via the selected at least one antenna. Another component (e.g., a radio frequency integrated circuit (RFIC)) other than the radiating element may be additionally formed as part of the antenna module 197.

At least some of the above-described components may be coupled mutually and communicate signals therebetween via an inter-peripheral communication scheme (e.g., a bus, general purpose input and output (GPIO), serial peripheral interface (SPI), or mobile industry processor interface (MIPI)).

Commands or data may be transmitted or received between the electronic device 101 and the external electronic device 104 via the server 108 coupled with the second network 199. Each of the electronic devices 102 and 104 may be a same type as, or a different type, from the electronic device 101. All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud, distributed, or client-server computing technology may be used, for example.

An electronic device according to an embodiment may be one of various types of electronic devices, including, but not limited to a portable communication device (e.g., a smart phone), a computer device, a portable multimedia device, a portable medical device, a camera, a wearable device, or a home appliance. However, the electronic device is not limited to any of those described above.

Various embodiments of the disclosure and the terms used herein are not intended to limit the technological features set forth herein to particular embodiments and include various changes, equivalents, or replacements for a corresponding embodiment.

With regard to the description of the drawings, similar reference numerals may be used to refer to similar or related elements.

A singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases.

As used herein, such terms as "1st" and "2nd", or "first" and "second" may be used to simply distinguish a corresponding component from another, and does not limit the components in other aspect (e.g., importance or order). If an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

The term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

A method according to an embodiment of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Each component (e.g., a module or a program) of the above-described components may include a single entity or multiple entities. One or more of the above-described components may be omitted, or one or more other components may be added. Alternatively or additionally, a plurality of components (e.g., modules or programs) may be integrated into a single component. In such a case, the integrated component may still perform one or more functions of each of the plurality of components in the same or similar manner as they are performed by a corresponding one of the plurality of components before the integration. Operations performed by the module, the program, or another component may be carried out sequentially, in parallel, repeatedly, or heuristically, or one or more of the operations may be executed in a different order or omitted, or one or more other operations may be added.

Figure 2:
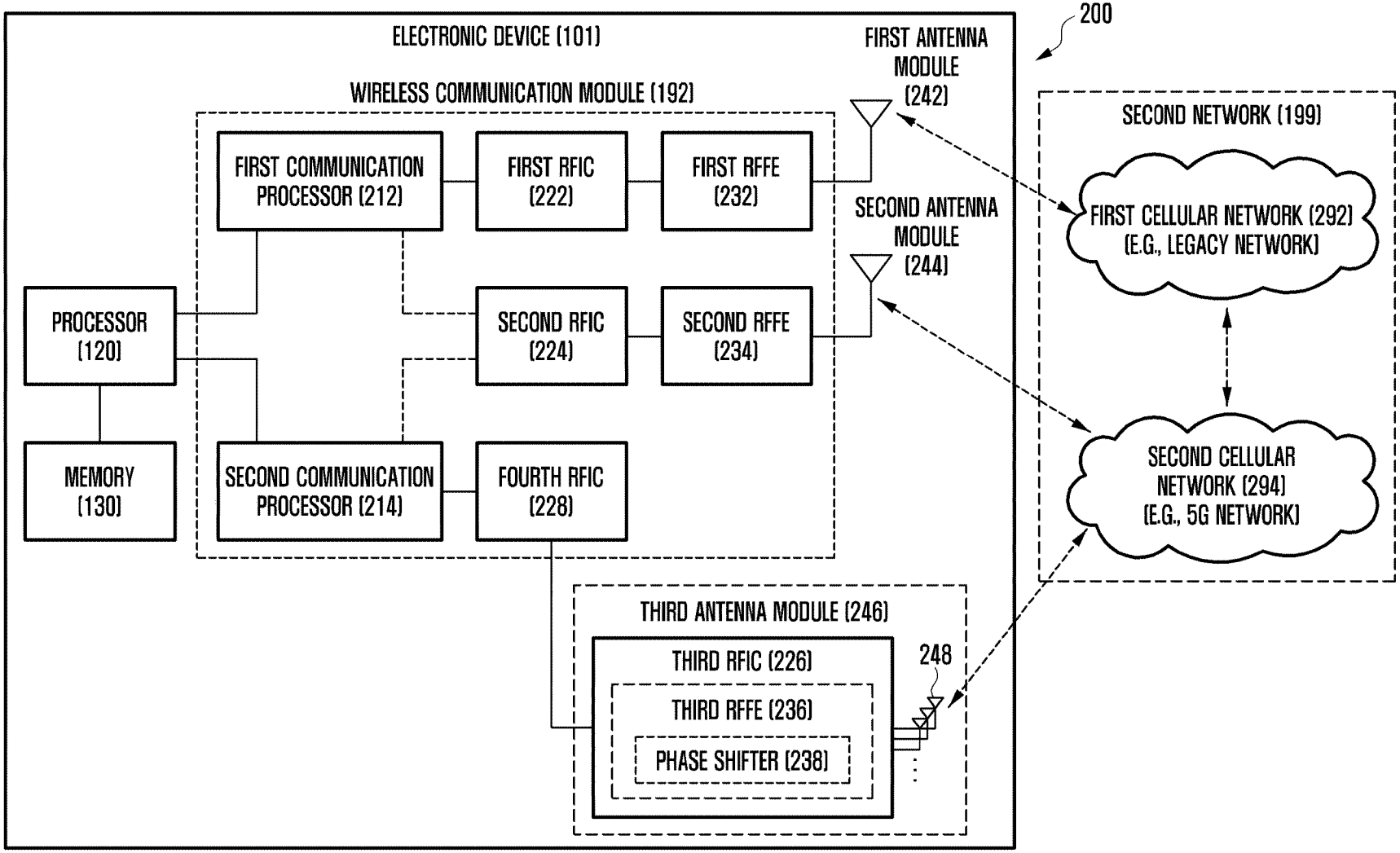
FIG. 2 illustrates a configuration of an electronic device in a network environment including a plurality of cellular networks according to an embodiment.

FIG. 2 illustrates an electronic device in a network environment including a plurality of cellular networks according to an embodiment.

Referring to FIG. 2, the electronic device 101 includes a first communication processor 212, second communication processor 214, first RFIC 222, second RFIC 224, third RFIC 226, fourth RFIC 228, first radio frequency front end (RFFE) 232, second RFFE 234, first antenna module 242, second antenna module 244, antenna 248, processor 120, and memory 130. A second network 199 includes a first cellular network 292 and a second cellular network 294. The electronic device 101 may further include at least one of the components described with reference to FIG. 1, and the second network 199 may further include at least one other network. The first communication processor 212, second communication processor 214, first RFIC 222, second RFIC 224, fourth RFIC 228, first RFFE 232, and second RFFE 234 may form at least part of the wireless communication module 192. The fourth RFIC 228 may be omitted or included as part of the third RFIC 226.

The first communication processor 212 may establish a communication channel of a band to be used for wireless communication with the first cellular network 292 and support legacy network communication through the established communication channel. The first cellular network may be a legacy network including a second generation (2G), 3G, 4G, or long term evolution (LTE) network. The second communication processor 214 may establish a communication channel corresponding to a designated band (e.g., about 6 GHz to about 60 GHz) of bands to be used for wireless communication with the second cellular network 294, and support 5G network communication through the established communication channel. The second cellular network 294 may be a 5G network defined in the 3G partnership project (3GPP).

The first communication processor 212 or the second communication processor 214 may establish a communication channel corresponding to another designated band (e.g., about 6 GHz or less) of bands to be used for wireless communication with the second cellular network 294 and support 5G network communication through the established communication channel. The first communication processor 212 and the second communication processor 214 may be implemented in a single chip or a single package. The first communication processor 212 or the second communication processor 214 may be formed in a single chip or a single package with the processor 120, the auxiliary processor 123, or the communication module 190.

Upon transmission, the first RFIC 222 may convert a baseband signal generated by the first communication processor 212 to a radio frequency (RF) signal of about 700 MHz to about 3 GHz used in the first cellular network 292 (e.g., legacy network). Upon reception, an RF signal may be obtained from the first cellular network 292 through the first antenna module 242 and be preprocessed through the first RFFE 232. The first RFIC 222 may convert the preprocessed RF signal to a baseband signal so as to be processed by the first communication processor 212.

Upon transmission, the second RFIC 224 may convert a baseband signal generated by the first communication processor 212 or the second communication processor 214 to an RF signal (hereinafter, 5G Sub6 RF signal) of a Sub6 band (e.g., 6 GHz or less) to be used in the second cellular network 294 (e.g., 5G network).

Upon reception, a 5G Sub6 RF signal may be obtained from the second cellular network 294 (e.g., 5G network) through the second antenna module 244 and be pretreated through the second RFFE 234. The second RFIC 224 may convert the preprocessed 5G Sub6 RF signal to a baseband signal so as to be processed by a corresponding communication processor of the first communication processor 212 or the second communication processor 214.

The third RFIC 226 may convert a baseband signal generated by the second communication processor 214 to an RF signal (hereinafter, 5G Above6 RF signal) of a 5G Above6 band (e.g., about 6 GHz to about 60 GHz) to be used in the second cellular network 294 (e.g., 5G network). Upon reception, a 5G Above6 RF signal may be obtained from the second cellular network 294 through the antenna 248 and be preprocessed through the third RFFE 236. The third RFIC 226 may convert the preprocessed 5G Above6 RF signal to a baseband signal so as to be processed by the second communication processor 214. The third RFFE 236 may be formed as part of the third RFIC 226.

The electronic device 101 may include a fourth RFIC 228 separately from the third RFIC 226 or as at least part of the third RFIC 226. In this case, the fourth RFIC 228 may convert a baseband signal generated by the second communication processor 214 to an RF signal (hereinafter, an intermediate frequency (IF) signal) of an intermediate frequency band (e.g., about 9 GHz to about 11 GHz) and transfer the IF signal to the third RFIC 226. The third RFIC 226 may convert the IF signal to a 5G Above 6RF signal. Upon reception, the 5G Above 6RF signal may be received from the second cellular network 294 through the antenna 248 and be converted to an IF signal by the third RFIC 226. The fourth RFIC 228 may convert an IF signal to a baseband signal so as to be processed by the second communication processor 214.

The first RFIC 222 and the second RFIC 224 may be implemented into at least part of a single package or a single chip. The first RFFE 232 and the second RFFE 234 may be implemented into at least part of a single package or a single chip. At least one of the first antenna module 242 and the second antenna module 244 may be omitted or may be combined with another antenna module to process RF signals of a corresponding plurality of bands.

The third RFIC 226 and the antenna 248 may be disposed at the same substrate to form a third antenna module 246. For example, the wireless communication module 192 or the processor 120 may be disposed at a first substrate (e.g., main printed circuit board (PCB)). The third RFIC 226 is disposed in a partial area (e.g., lower surface) of the first substrate and a separate second substrate (e.g., sub PCB), and the antenna 248 is disposed in another partial area (e.g., upper surface) of the first substrate and a separate second substrate, thereby forming the third antenna module 246. By disposing the third RFIC 226 and the antenna 248 in the same substrate, a length of a transmission line therebetween can be reduced. This may reduce a loss (e.g., attenuation) of a signal of a high frequency band (e.g., about 6 GHz to about 60 GHz) to be used in 5G network communication by a transmission line. Therefore, the electronic device 101 may improve a quality or speed of communication with the second cellular network 294.

The antenna 248 may be formed in an antenna array including a plurality of antenna elements that may be used for beamforming. In this case, the third RFIC 226 may include a plurality of phase shifters 238 corresponding to a plurality of antenna elements as part of the third RFFE 236. Upon transmission, each of the plurality of phase shifters 238 may convert a phase of a 5G Above6 RF signal to be transmitted to the outside (e.g., a base station of a 5G network) of the electronic device 101 through a corresponding antenna element. Upon reception, each of the plurality of phase shifters 238 may convert a phase of the 5G Above6 RF signal received from the outside to the same phase or substantially the same phase through a corresponding antenna element. This enables transmission or reception through beamforming between the electronic device 101 and the outside.

The second cellular network 294 may operate (e.g., standalone (SA)) independently of the first cellular network 292 (e.g., legacy network) or may be operated (e.g., non-standalone (NSA)) in connection with the first cellular network 292. For example, the 5G network may have only an access network (e.g., 5G radio access network (RAN) or a next generation (NG) RAN and have no next generation core (NGC). After accessing to the access network of the 5G network, the electronic device 101 may access to an external network (e.g., Internet) under the control of a core network (e.g., an evolved packed core (EPC)) of the legacy network. LTE protocol information for communication with a legacy network or new radio (NR) protocol information for communication with a 5G network may be stored in the memory 130 to be accessed by the processor 120, the first communication processor 212, or the second communication processor 214.

Figure 3A:
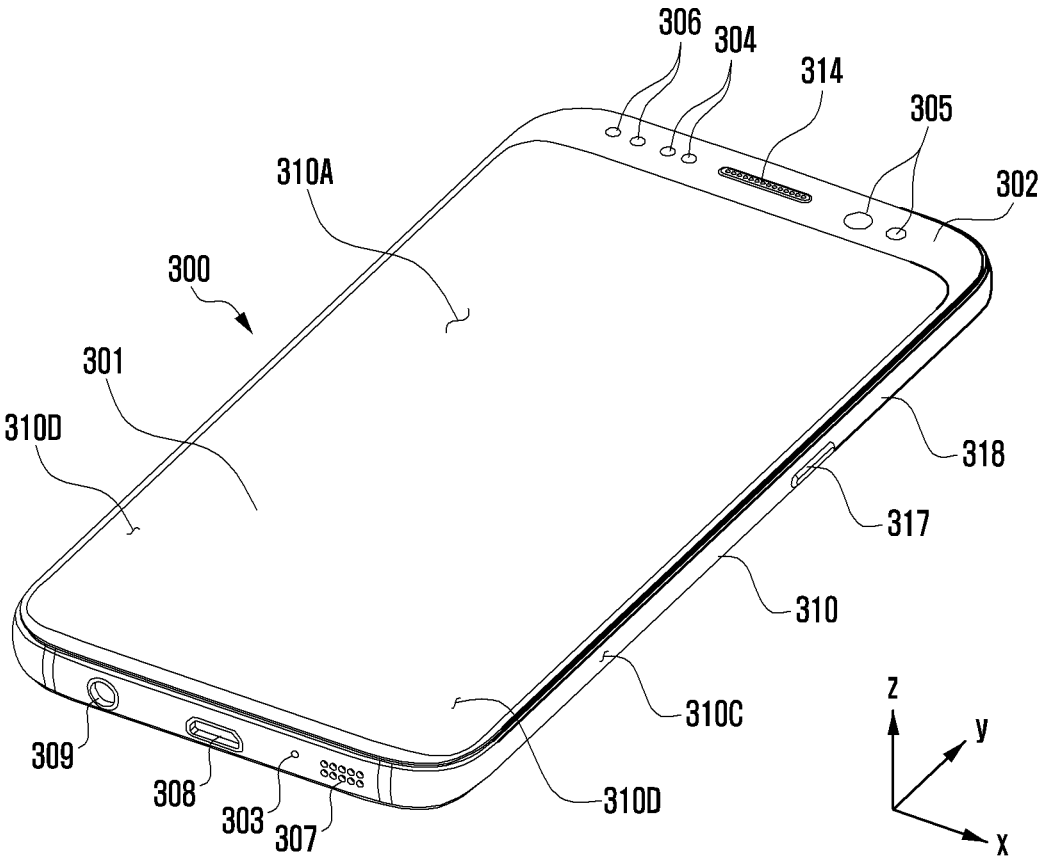
FIG. 3A is a perspective view illustrating a mobile electronic device according to an embodiment.

FIG. 3A is a front perspective view illustrating a mobile electronic device 300 according to an embodiment.

Figure 3B:
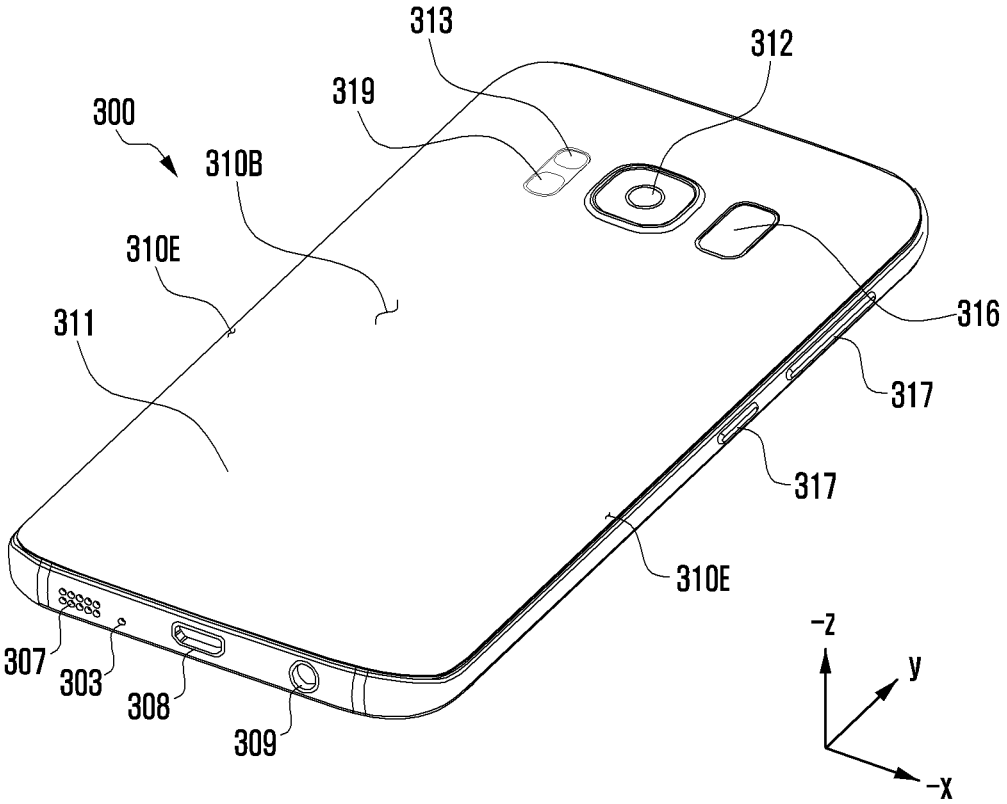
FIG. 3B is a rear perspective view illustrating a mobile electronic device according to an embodiment.

FIG. 3B is a rear perspective view illustrating a mobile electronic device 300 according to an embodiment.

Referring to FIGS. 3A and 3B, the mobile electronic device 300 includes a housing 310 including a first surface (or front surface) 310A, a second surface (or rear surface) 310B, and a side surface 310C enclosing a space between the first surface 310A and the second surface 310B. The housing may refer to a structure forming some of the first surface 310A, the second surface 310B, and the side surface 310C. The first surface 310A may be formed by an at least partially substantially transparent front plate 302 (e.g., a polymer plate or a glass plate including various coating layers). The second surface 310B may be formed by a substantially opaque rear plate 311. The rear plate 311 may be formed by coated or colored glass, ceramic, polymer, metal (e.g., aluminum, stainless steel (STS), or magnesium), or a combination of at least two of the above materials. The side surface 310C may be coupled to the front plate 302 and the rear plate 311 and be formed by a side bezel structure (or "side member") 318 including a metal and/or a polymer. The rear plate 311 and the side bezel structure 318 may be integrally formed and include the same metal material, such as aluminum.

The front plate 302 may include two first regions 310D bent and extended seamlessly from the first surface 310A toward the rear plate 311 at both ends of a long edge of the front plate 302. In FIG. 3B, the rear plate 311 may include two second regions 310E bent and extended seamlessly from the second surface 310B towards the front plate 302 at both ends of a long edge. The front plate 302 (or the rear plate 311) may include only one of the first regions 310D (or the second regions 310E). A portion of the first regions W the above embodiments, when viewed from the side surface of the mobile electronic device 300, the side bezel structure 318 may have a first thickness (or width) at a side surface in which the first region 310D or the second region 310E is not included and have a second thickness less than the first thickness at a side surface including the first region 310D or the second region 310E.

The mobile electronic device 300 may include at least one of a display 301, audio modules 303, 307, and 314 sensor modules 304, 316, and 319, camera modules 305, 312, and 313, a key input device 317, a light emitting element 306, and connector holes 308 and 309. The mobile electronic device 300 may omit at least one of the components or may further include other components.

The display 301 may be exposed through a substantial portion of the front plate 302. At least part of the display 301 may be exposed through the front plate 302 forming the first region 310D of the side surface 310C and the first surface 310A. An edge of the display 301 may be formed to be substantially the same as an adjacent outer edge shape of the front plate 302. In order to enlarge an area where the display 301 is exposed, a distance between an outer edge of the display 301 and an outer edge of the front plate 302 may be formed to be substantially the same.

A recess or an opening may be formed in a portion of a screen display area of the display 301, and at least one of the audio module 314 and the sensor module 304, the camera module 305, and the light emitting element 306 aligned with the recess or the opening may be included. At least one of the audio module 314, the sensor module 304, the camera module 305, the fingerprint sensor module 316, and the light emitting element 306 may be included at a rear surface of a screen display area of the display 301. The display 301 may be coupled to or disposed adjacent to a touch detection circuit, a pressure sensor capable of measuring intensity (pressure) of the touch, and/or a digitizer for detecting a stylus pen of a magnetic field method. At least part of the sensor modules 304 and 319 and/or at least part of the key input device 317 may be disposed in a first region 310D and/or a second region 310E.

The audio modules 303, 307, and 314 may include a microphone hole 303 and speaker holes 307 and 314. The microphone hole 303 may dispose a microphone for obtaining an external sound, and plurality of microphones may be disposed to detect a direction of a sound. The speaker holes 307 and 314 may include an external speaker hole 307 and a call receiver hole 314. The speaker holes 307 and 314 and the microphone hole 303 may be implemented into one hole, or the speaker may be included without the speaker holes 307 and 314 (e.g., piezo speaker).

The sensor modules 304, 316, and 319 may generate an electrical signal or a data value corresponding to an operating state inside the mobile electronic device 300 or an environment state outside the mobile electronic device 300. The sensor modules 304, 316, and 319 may include a first sensor module 304 (e.g., proximity sensor) and/or a second sensor module (e.g., fingerprint sensor), disposed at the first surface 310A of the housing 310, and/or a third sensor module 319 (e.g., a heart rate monitor (HRM) sensor) and/or a fourth sensor module 316 (e.g., fingerprint sensor), disposed at the second surface 310B of the housing 310. The fingerprint sensor may be disposed at the second surface 310B as well as the first surface 310A (e.g., the display 301) of the housing 310. The mobile electronic device 300 may further include at least one of a gesture sensor, gyro sensor, air pressure sensor, magnetic sensor, acceleration sensor, grip sensor, color sensor, IR sensor, biometric sensor, temperature sensor, humidity sensor, and illumination sensor 304.

The camera modules 305, 312, and 313 may include a first camera device 305 disposed at the first surface 310A of the mobile electronic device 300, a second camera device 312 disposed at the second surface 310B of the mobile electronic device 300, and/or a flash 313. The camera modules 305 and 312 may include one or a plurality of lenses, an image sensor, and/or an image signal processor. The flash 313 may include a light emitting diode or a xenon lamp. Two or more lenses (infrared camera, wide angle and telephoto lens) and image sensors may be disposed at one surface of the mobile electronic device 300.

The key input device 317 may be disposed at the side surface 310C of the housing 310. The mobile electronic device 300 may not include some or all of the above-described key input devices 317, and the key input device 317 that is not included may be implemented in other forms such as a soft key on the display 301. The key input device 317 may include a sensor module 316 disposed at the second surface 310B of the housing 310.

The light emitting element 306 may be disposed at the first surface 310A of the housing 310. The light emitting element 306 may provide status information of the mobile electronic device 300 in an optical form. In one embodiment, the light emitting element 306 may provide a light source interworking with an operation of the camera module 305. The light emitting element 306 may include a light emitting diode (LED), an IR LED, and a xenon lamp.

The connector ports 308 and 309 may include a first connector port 308 that may receive a USB connector for transmitting and receiving power and/or data to and from an external electronic device and/or a second connector hole (e.g., earphone jack) 309 that can receive a connector for transmitting and receiving audio signals to and from an external electronic device.

Figure 3C:
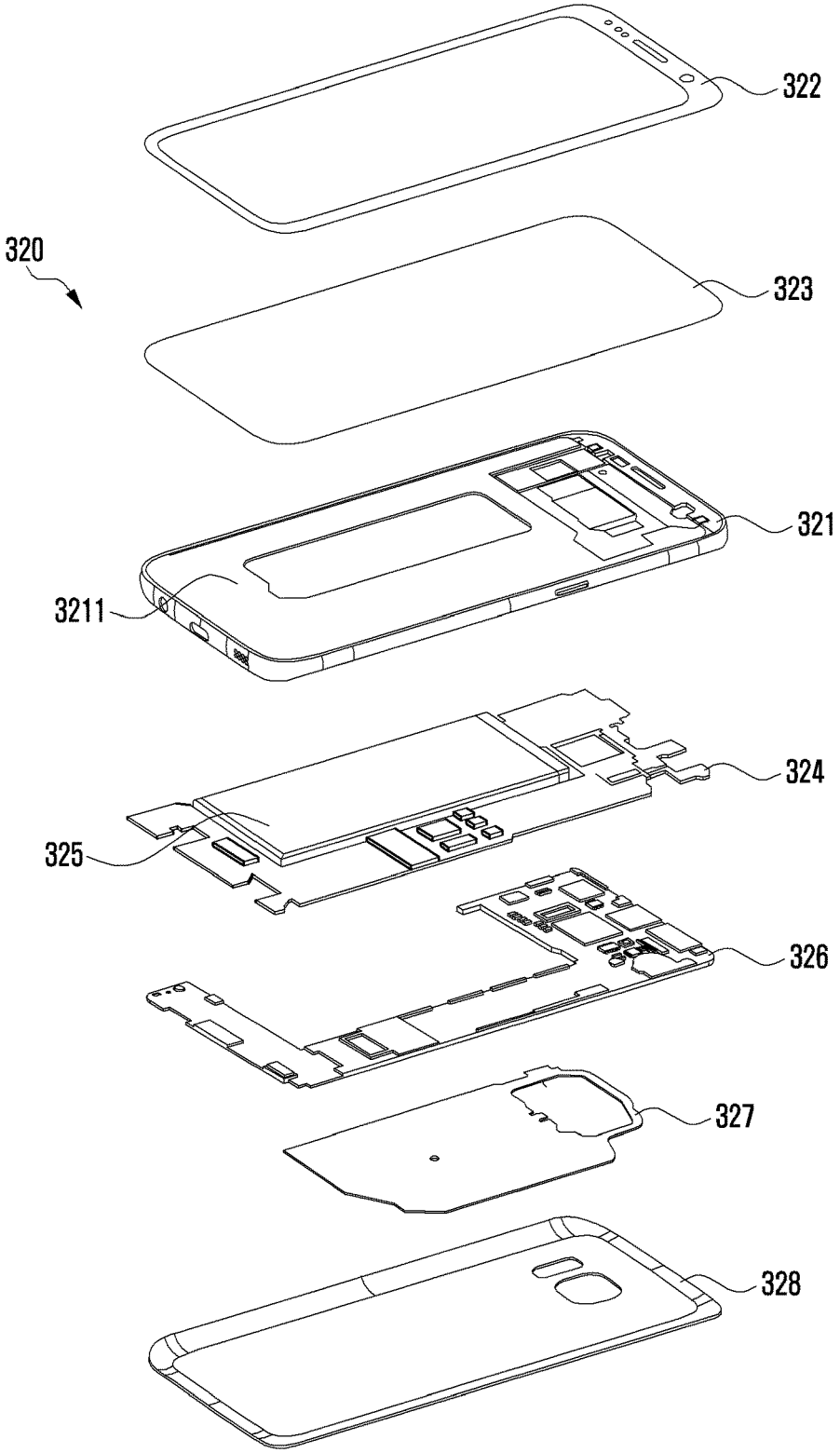
FIG. 3C is an exploded perspective view illustrating a mobile electronic device according to an embodiment.

FIG. 3C is an exploded perspective view illustrating a mobile electronic device according to an embodiment.

Referring to FIG. 3C, the mobile electronic device 320 may include a side bezel structure 321, first support member 3211 (e.g., bracket), front plate 322, display 323, printed circuit board 324, battery 325, second support member 326 (e.g., rear case), antenna 327, and rear plate 328. The electronic device 320 may omit at least one of the components or may further include other components. At least one of the components of the electronic device 320 may be the same as or similar to at least one of the components of the mobile electronic device 300 of FIG. 3A or 3B and a duplicated description is omitted below.

The first support member 3211 may be disposed inside the electronic device 320 to be connected to the side bezel structure 321 or may be integrally formed with the side bezel structure 321. The first support member 3211 may be made of a metal material and/or a non-metal (e.g., polymer) material. The display 323 may be coupled to one surface of the first support member 3211, and the printed circuit board 324 may be coupled to an opposing surface of the first support member 3211. A processor, a memory, and/or an interface may be mounted in the printed circuit board 324. The processor may include one or more of a central processing unit, application processor, graphic processing unit, image signal processor, sensor hub processor, and communication processor.

The memory may include a volatile memory or a non-volatile memory.

The interface may include a HDMI, USB interface, SD card interface, and/or audio interface. The interface may electrically or physically connect the electronic device 320 to an external electronic device and include a USB connector, an SD card/multimedia card (MMC) connector, or an audio connector.

The battery 325 supplies power to at least one component of the electronic device 320 and may include a non-rechargeable primary battery, a rechargeable secondary battery, or a fuel cell. At least part of the battery 325 may be disposed on substantially the same plane as that of the printed circuit board 324. The battery 325 may be integrally disposed inside the electronic device 320 or may be detachably disposed in the electronic device 320.

The antenna 327 may be disposed between the rear plate 328 and the battery 325, and may include a near field communication (NFC) antenna, wireless charging antenna, and/or magnetic secure transmission (MST) antenna. The antenna 327 may perform short range communication with an external device or may wirelessly transmit and receive power required for charging. An antenna structure may be formed by some or a combination of the side bezel structure 321 and/or the first support member 3211.

Figure 4A:
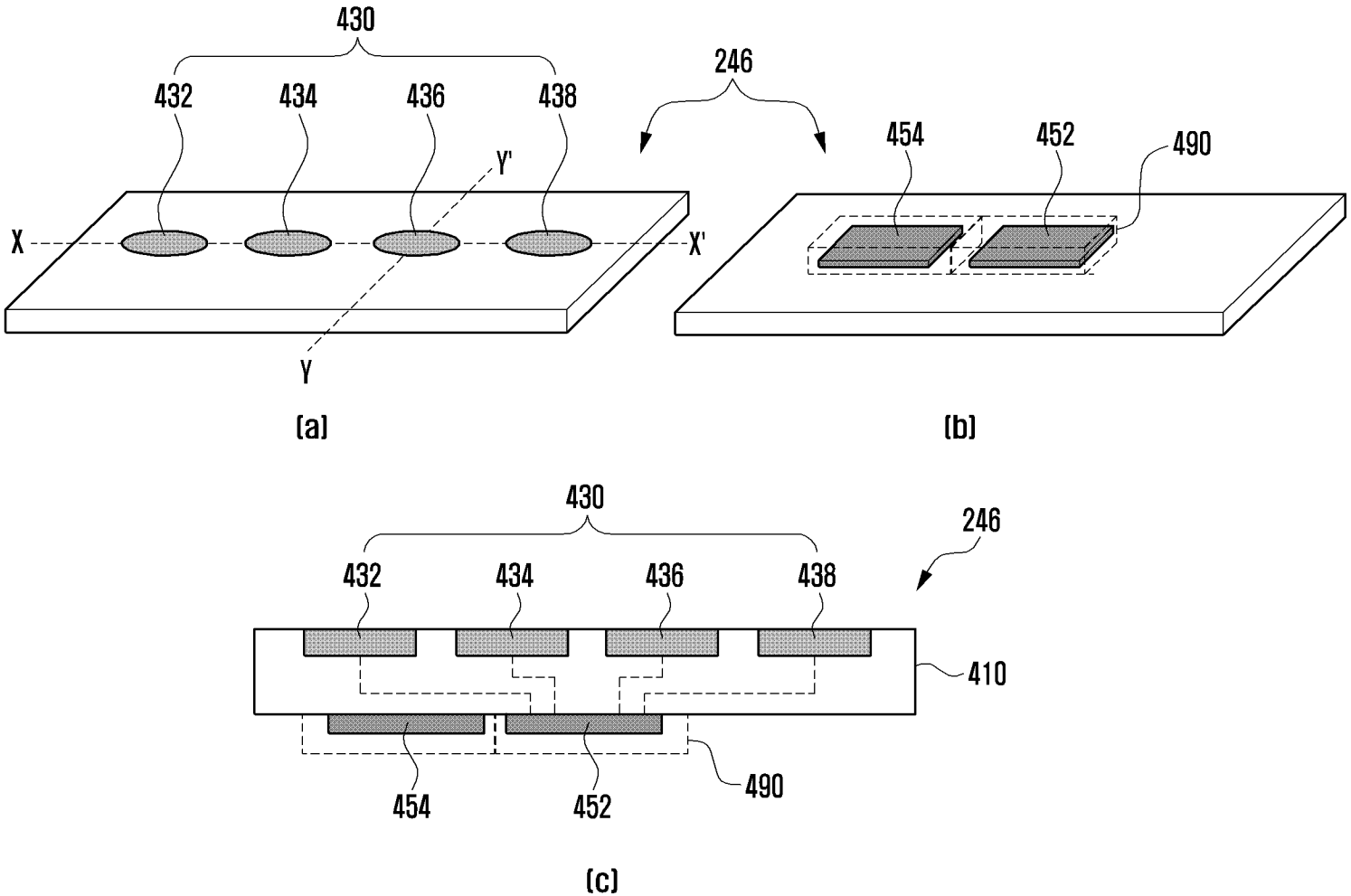
FIG. 4A illustrates a structure of a third antenna module according to an embodiment.

FIG. 4A illustrates a structure of a third antenna module described with reference to FIG. 2 according to an embodiment.

FIG. 4A at (a) is a perspective view illustrating the third antenna module 246 viewed from one side, FIG. 4A at (b) is a perspective view illustrating the third antenna module 246 viewed from the other side, and FIG. 4A at (c) is a cross-sectional view illustrating the third antenna module 246 taken along line X-X' of FIG. 4A at (a).

With reference to FIG. 4A, the third antenna module 246 includes a printed circuit board 410, an antenna array 430, a RFIC 452, and a PMIC 454. The third antenna module 246 further includes a shield member 490. At least one of the above-described components may be omitted or at least two of the components may be integrally formed.

The printed circuit board 410 may include a plurality of conductive layers and a plurality of non-conductive layers stacked alternately with the conductive layers. The printed circuit board 410 may provide electrical connections between the printed circuit board 410 and/or various electronic components disposed outside using wirings and conductive vias formed in the conductive layer.

The antenna array 430 includes a plurality of antenna elements 432, 434, 436, or 438 disposed to form a directional beam. The antenna elements 432, 434, 436, or 438 may be formed at a first surface of the printed circuit board 410. The antenna array 430 may be formed inside the printed circuit board 410. The antenna array 430 may include the same or a different shape or type of a plurality of antenna arrays (e.g., dipole antenna array and/or patch antenna array).

The RFIC 452 may be disposed at a second surface opposite to the first surface of the printed circuit board 410 spaced apart from the antenna array. The RFIC 452 is configured to process signals of a selected frequency band transmitted/received through the antenna array 430. Upon transmission, the RFIC 452 may convert a baseband signal obtained from a communication processor to an RF signal of a designated band. Upon reception, the RFIC 452 may convert an RF signal received through the antenna array 430 to a baseband signal and transfer the baseband signal to the communication processor.

Upon transmission, the RFIC 452 may up-convert an IF signal (e.g., about 9 GHz to about 11 GHz) obtained from an intermediate frequency integrate circuit (IFIC) to an RF signal of a selected band. Upon reception, the RFIC 452 may down-convert the RF signal obtained through the antenna array 430, convert the RF signal to an IF signal, and transfer the IF signal to the IFIC.

The PMIC 454 may be disposed in another partial area (e.g., the second surface) of the printed circuit board 410 spaced apart from the antenna array 430. The PMIC 454 may receive a voltage from a main PCB to provide power necessary for the RFIC 452 on the antenna module.

The shielding member 490 may be disposed at a portion (e.g., the second surface) of the printed circuit board 410 so as to electromagnetically shield at least one of the RFIC 452 or the PMIC 454. The shield member 490 may include a shield can.

Alternatively, the third antenna module 246 may be electrically connected to another printed circuit board (e.g., main circuit board) through a module interface. The module interface may include a connecting member a coaxial cable connector, board to board connector, interposer, or flexible PCB (FPCB). The RFIC 452 and/or the PMIC 454 of the antenna module may be electrically connected to the printed circuit board through the connection member.

Figure 4B:
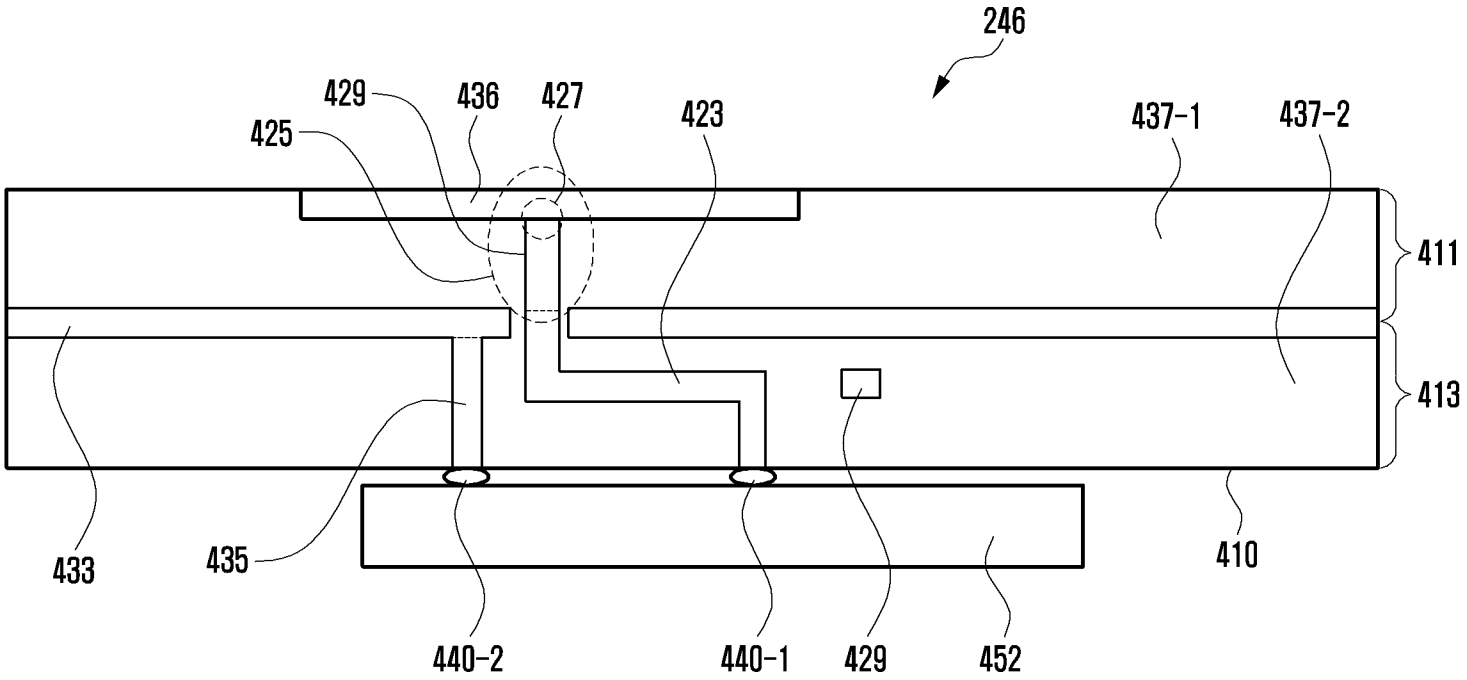
FIG. 4B is a cross-sectional view illustrating the third antenna module taken along line Y-Y' of FIG. 4A(a) according to an embodiment.

FIG. 4B is a cross-sectional view illustrating the third antenna module 246 taken along line Y-Y' of FIG. 4A at (a) according to an embodiment. The PCB 410 of the illustrated embodiment may include an antenna layer 411 and a network layer 413.

Referring to FIG. 4B, the antenna layer 411 includes at least one dielectric layer 437-1, and an antenna element 436 and/or a power feeding portion 425 formed on or inside an outer surface of a dielectric layer. The power feeding portion 425 may include a power feeding point 427 and/or a power feeding line 429.

The network layer 413 includes at least one dielectric layer 437-2, at least one ground layer 433, at least one conductive via 435, a transmission line 423, and/or a power feeding line 429 formed on or inside an outer surface of the dielectric layer.

The RFIC 452 of FIG. 4A at (c) may be electrically connected to the network layer 413 through first and second solder bumps 440-1 and 440-2. Alternatively, various connection structures (e.g., solder or ball grid array (BGA)) instead of the solder bumps may be used. The RFIC 452 may be electrically connected to the antenna element 436 through the first solder bump 440-1, the transmission line 423, and the power feeding portion 425. The RFIC 452 may also be electrically connected to the ground layer 433 through the second solder bump 440-2 and the conductive via 435. The RFIC 452 may also be electrically connected to the above-described module interface through the power feeding line 429.

Figure 5:
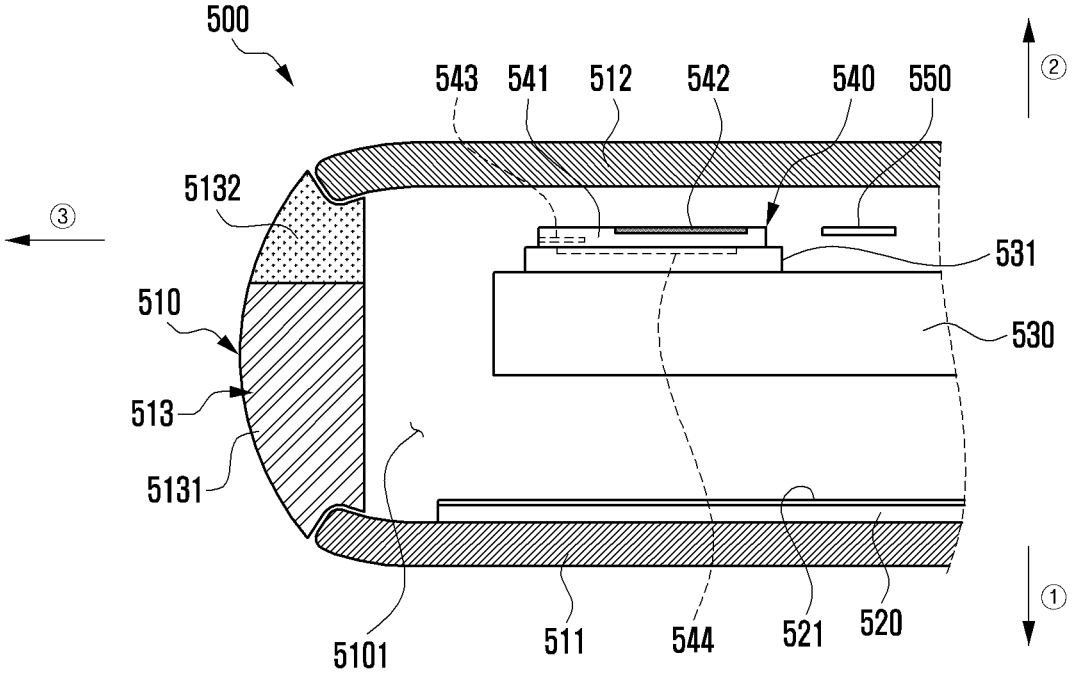
FIG. 5 is a cross-sectional view partially showing an electronic device according to an embodiment.

FIG. 5 is a cross-sectional view partially showing an electronic device 500 according to an embodiment.

An antenna module 540 of FIG. 5 may be similar, at least in part, to the third antenna module 246 of FIG. 2, or may include other embodiments of the antenna module.

Referring to FIG. 5, the electronic device 500 includes a housing 510 that includes a first plate 511 (e.g., a front plate) facing a first direction (indicated by ①) (e.g., the z direction in FIG. 3A), a second plate 512 (e.g., a rear plate) facing a second direction (indicated by ②) (e.g., the −z direction in FIG. 3A) opposite to the first direction, and a lateral member 513 surrounding an inner space 5101 between the first plate 511 and the second plate 512. The lateral member 513 may include a conductive portion 5131 and a non-conductive portion 5132. The conductive portion 5131 may include a metal material. The non-conductive portion 5132 may include a polymer. The lateral member 513 may be formed such that the non-conductive portion 5132 is insert-injected into the conductive portion 5131. Alternatively, the lateral member 513 may be formed by a structural combination of the conductive portion 5131 and the non-conductive portion 5132. When the lateral member 513 is viewed from the outside, the non-conductive portion 5132 may be disposed at a position overlapping at least with the antenna module 540.

The second plate 512 may be formed of coated or colored glass, ceramic, polymer, or any combination thereof. The first plate 511 and/or the second plate 512 may include only a flat portion or include a flat portion and a curved portion (e.g., an edge portion) extending from the flat portion. The electronic device 500 may include a display 520 that is disposed in the inner space 5101 and visible to the outside through at least a portion of the first plate 511. The display 520 may include a flexible touch screen display. The display 520 may include a conductive plate 521 formed for insulation and noise shielding. The conductive plate 521 may include a copper (Cu) sheet in the form of an adhesive film.

The electronic device 500 may include the antenna module 540 disposed in the inner space 5101. The antenna module 540 may include, as an antenna structure, a substrate 541, a first antenna array 542 having at least one first antenna element (e.g., antenna elements 5421, 5422, 5423, and 5424 in FIG. 6A) disposed on the substrate 541, and a second antenna array 543 having at least one second antenna element (e.g., antenna elements 5431, 5432, 5433, and 5434 in FIG. 6A) disposed around the first antenna array 542. The at least one first antenna element (e.g., the antenna elements 5421, 5422, 5423, and 5424 in FIG. 6A) may include a conductive patch. The at least one second antenna element may include a conductive pattern (e.g., a dipole antenna element). The antenna module 540 may further include a wireless communication circuit 544 disposed on the substrate 541 and electrically connected to the first antenna array 542 and/or the second antenna array 543. The wireless communication circuit 544 may be configured to transmit and/or receive a signal having a frequency of at least a partial band (e.g., a band from 24 GHz to 30 GHz or a band from 37 GHz to 40 GHz) in a band from about 3 GHz to about 100 GHz through the first antenna array 542 and/or the second antenna array 543. The wireless communication circuit 544 may be configured to form a beam pattern in a direction (indicated by ②) of the second plate 512 from the first antenna array 542. The wireless communication circuit 544 may be configured to form a beam pattern in a direction (indicated by ③) of the lateral member 513 through the non-conductive portion 5132 from the second antenna array 543. In another embodiment, the antenna module 540 may include only one of the first and second antenna arrays 542 and 543.

The antenna module 540 may be disposed on a PCB 530 (also referred to as a device substrate or a main board) through a support member 531 in the inner space 5101 of the electronic device 500. The support member 531 may include an interposer for electrically connecting the antenna module 540 to the PCB 530. The support member 531 may include a dielectric structure (e.g., an injection structure or a dielectric carrier) for fixing the antenna module 540 to the PCB 530. The antenna module 540 may be mounted directly on the PCB 530, or may be fixedly disposed on a certain structure in the inner space 5101 of the electronic device 500 and electrically connected to the PCB 530 through an FPCB.

The electronic device 500 may include a conductive member 550 disposed near the antenna module 540 in the inner space 5101 of the electronic device 500. In this case, the conductive member 550 may be spaced apart from the antenna module 540 at a certain interval and disposed side by side. The conductive member 550 may be supported through at least one structure (e.g., a support plate made of a dielectric material) disposed in the inner space 5101 of the electronic device 500. The conductive member 550 may include a conductive tape or a laser direct structuring (LDS) pattern disposed on an inner surface of the second plate 512. When the second plate 512 is formed of a polymer material, the conductive member 550 may be disposed through an insert injection into the second plate 512. The conductive member 550 may be disposed on an outer surface of the second plate 512. In this case, the conductive member 550 may be replaced with a conductive decorative member disposed on the outer surface of the second plate 512. The conductive member 550 may be disposed in an extended area of the substrate 541. In this case, the conductive member 550 may be formed in a conductive pattern having a certain shape and size on the substrate 541. The conductive member 550 may prevent the radiation performance of the first antenna array 542 and/or the second antenna array 543 from being degraded due to a dielectric structure disposed around the antenna module 540. The conductive member 550 may be replaced with a conductive structure disposed near the antenna module 540. For example, the conductive member 550 may be replaced with at least a portion of the conductive decorative member (e.g., a conductive decorative member 850 in FIG. 8) disposed near the antenna module 540. The conductive member 550 may be replaced with at least a portion of a legacy antenna structure (e.g., a second antenna structure 930 in FIG. 9) disposed near the antenna module 540. The legacy antenna structure may be used for communication in a frequency band of 6 GHz or less for the LTE communication.

Figure 6A:
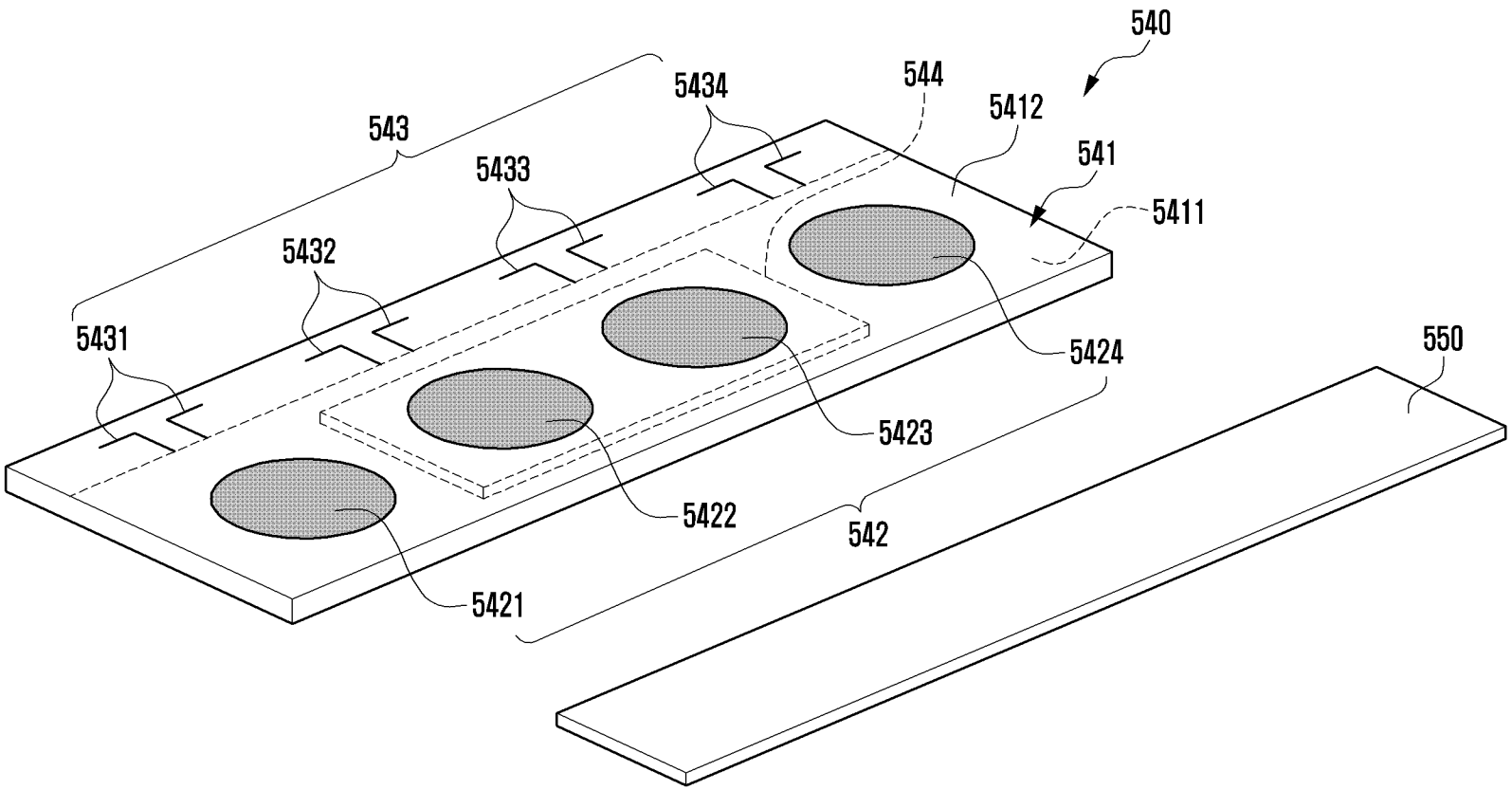
FIG. 6A is a perspective view showing an antenna module according to an embodiment.

FIG. 6A is a perspective view showing an antenna module 540 according to an embodiment.

The antenna module 540 of FIG. 6A may be similar, at least in part, to the third antenna module 246 of FIG. 2, or may include other embodiments of the antenna module.

Referring to FIG. 6A, the antenna module 540 may include the substrate 541 that includes a first surface 5411 facing a first plate (e.g., the first plate 511 in FIG. 5) and a second surface 5412 opposite to the first surface 5411 and facing a second plate (e.g., the second plate 512 in FIG. 5). The antenna module 540 may further include the wireless communication circuit 544 disposed on the first surface 5411 of the substrate 541, and the first antenna array 542 that includes a plurality of first antenna elements 5421, 5422, 5423, and 5424 which are disposed at regular intervals on the second surface 5412 of the substrate 541 or near the second surface 5212 in the substrate 541. The antenna elements 5421, 5422, 5423, and 5424 are electrically connected to the wireless communication circuit 544. The antenna module 540 may also include the second antenna array 543 that includes a plurality of second antenna elements 5431, 5432, 5433, and 5434 which are disposed at regular intervals in an edge portion of the substrate 541. In the antenna module 540, the plurality of first antenna elements 5421, 5422, 5423, and 5424 of the first antenna array 542 may have a 1×4 arrangement, and also the plurality of second antenna elements 5431, 5432, 5433, and 5434 of the second antenna array 543 may have a 1×4 arrangement.

Each of the first antenna array 542 and the second antenna array 543 may include a single antenna element, two antenna elements having a 1×2 arrangement, three antenna elements having a 1×3 arrangement, or N antenna elements having a 1×N arrangement, where N is at least five. Alternatively, the antenna array 542 may include antenna elements having a multi-row multi-column arrangement. As shown, the first antenna array 542 may include a first antenna element 5421, a second antenna element 5422, a third antenna element 5423, and a fourth antenna element 5424, which are sequentially arranged. In addition, as shown, the second antenna array 543 may include a fifth antenna element 5431, a sixth antenna element 5432, a seventh antenna element 5433, and an eighth antenna element 5434, which are sequentially arranged. Each of the first antenna elements 5421, 5422, 5423, and 5424 of the first antenna array 542 may include a conductive patch disposed on the second surface 5412 of the substrate 541 and used as a patch antenna. Each of the second antenna elements 5431, 5432, 5433, and 5434 of the second antenna array 543 may include a conductive pattern disposed in the edge portion of the substrate 541 and used as a dipole antenna. The wireless communication circuit 544 may form a beam pattern in a second direction indicated by ② in FIG. 5 of a second plate 512 in FIG. 5 from the first antenna array 542. The wireless communication circuit 544 may form a beam pattern in a third direction indicated by ③ in FIG. 5 of a lateral member 513 in FIG. 5 from the second antenna array 543.

The conductive member 550 may be disposed near the substrate 541 in parallel with a longitudinal direction of the substrate 541. The conductive member 550 may be provided separately for the antenna module 540 or may include at least a part of a conductive decorative member or a conductive antenna structure disposed in the electronic device. In order to improve the radiation performance of the antenna module 540, the conductive member 550 may be formed with a suitable size and shape at a suitable position in consideration of the radiation characteristics of the antenna module 540 whose performance is degraded by the material characteristics of surrounding dielectrics (e.g., the second plate).

Figure 6B:
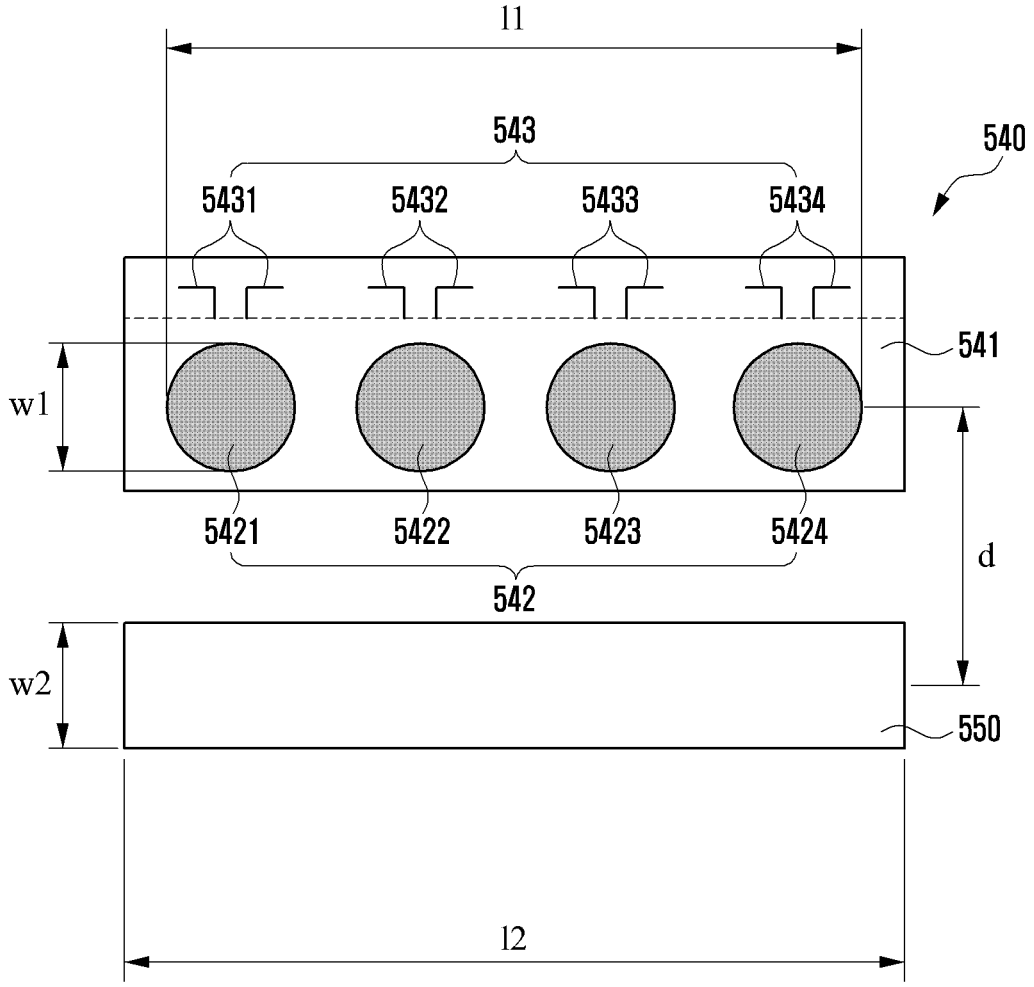
FIG. 6B is a plan view showing an arrangement relationship between an antenna module and a conductive member according to an embodiment.

FIG. 6B is a plan view showing an arrangement relationship between the antenna module 540 and the conductive member 550 according to an embodiment.

Referring to FIG. 6B, the antenna module 540 includes the substrate 541 which may have a rectangular shape. The conductive member 550 may be disposed near the substrate 541. The conductive member 550 may be formed of a rectangular shape having a certain length (l2) and a certain width (w2) and may be disposed in parallel with and adjacent to the substrate 541. The length (l2) of the conductive member 550 may be determined in a range of 0.5 to 1.5 times a length (l1) of the first antenna array 542. The width (w2) of the conductive member 550 may be determined in a range of 0.5 to 1.5 times a width (w1) of the first antenna array 542. A distance (d) between the center of the conductive member 550 and the center of the first antenna array 542 may be determined in a range of ½λ to λ. The conductive member 550 may be a conductive pattern that has a certain shape and a certain size and is directly formed at a position satisfying the above disposition conditions in an extended area of the substrate 541 of the antenna module 540.

Figure 7:
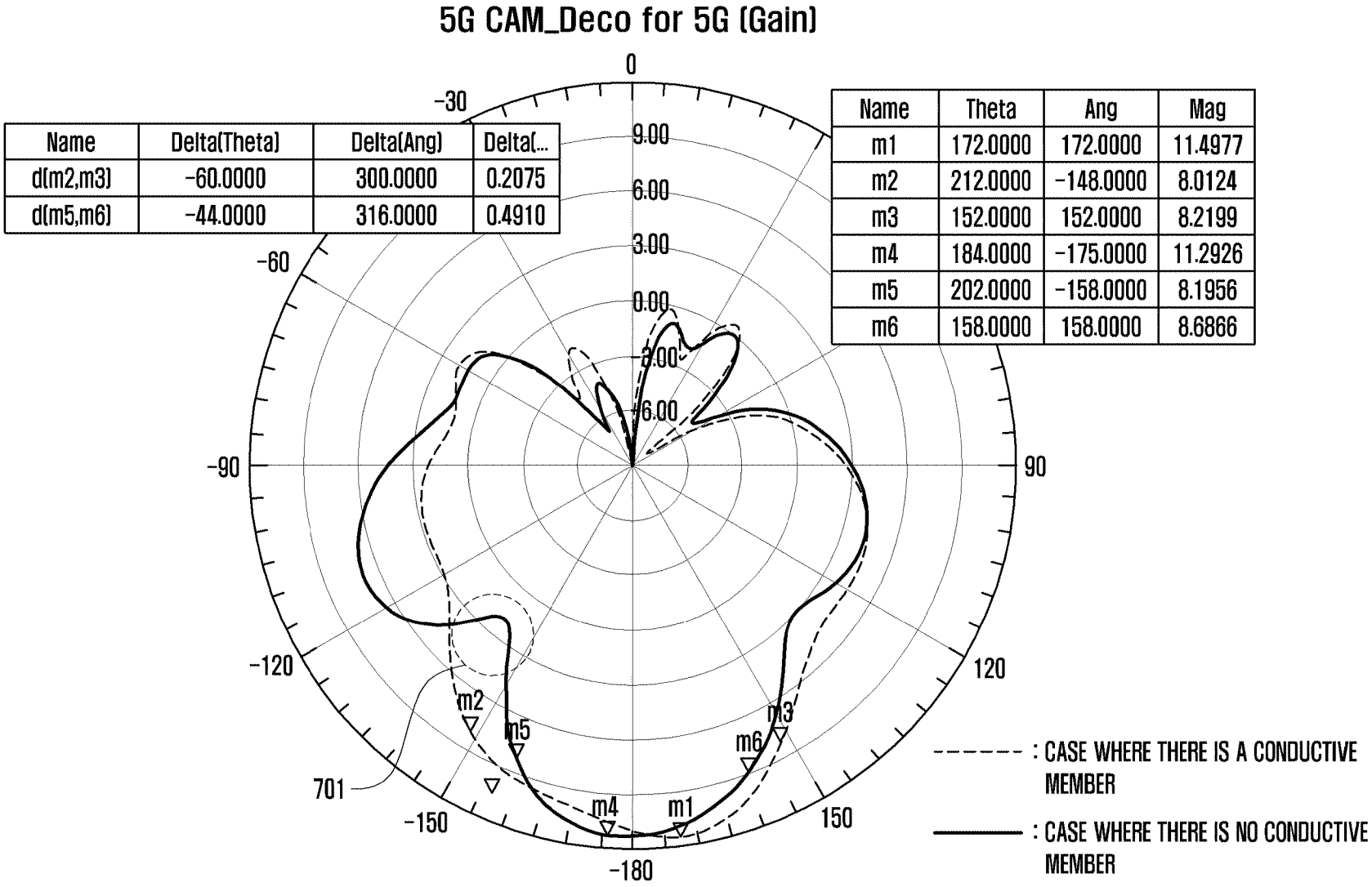
FIG. 7 illustrates a radiation pattern of an antenna module depending on whether a conductive member is disposed according to an embodiment.

FIG. 7 illustrates a radiation pattern of the antenna module 540 depending on whether the conductive member 550 is disposed according to an embodiment.

Referring to FIG. 7, when there is no conductive member near the antenna module, a null 701 may occur. Therefore, the radiation performance of the antenna module may be degraded. In contrast, when the conductive member is disposed near the antenna module, the null is improved and the half power beam width (HPBW) of a beam is improved from 44 degrees to 60 degrees. Accordingly, the manner of disposing the conductive member can improve the radiation performance of the antenna module.

Figure 8:
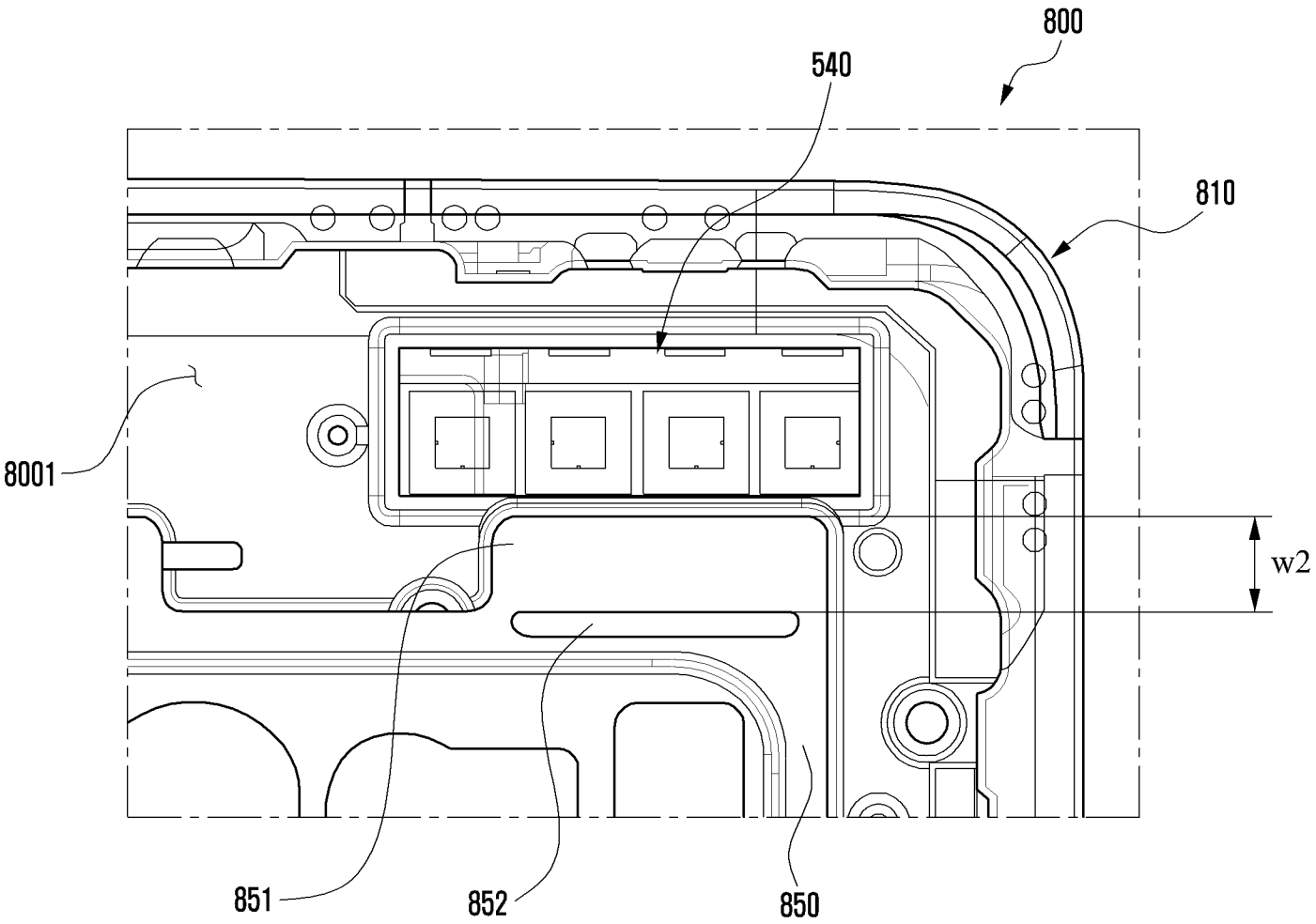
FIG. 8 illustrates an electronic device in which at least a part of a decorative member is replaced with a conductive member according to an embodiment.

FIG. 8 illustrates an electronic device 800 in which at least a part of a decorative member 850 is replaced with a conductive member according to an embodiment.

The electronic device 800 of FIG. 8 may be similar, at least in part, to the electronic device 101 of FIG. 1, the electronic device 300 of FIG. 3A, or the electronic device 500 of FIG. 5, or may include other embodiments of the electronic device.

Referring to FIG. 8, the electronic device 800 includes a housing 810 having an inner space 8001. The electronic device 800 may include the antenna module 540 disposed at a certain position in the inner space 8001 of the housing 810. The antenna module 540 is the substantially same as the antenna module 540 shown in FIG. 5, so that a detailed description thereof is omitted.

The electronic device 800 may include the decorative member 850 disposed in the inner space 8001 of the housing 810. The decorative member 850 may be formed of a conductive material and disposed to be visible from the outside in the inner space 8001 of the electronic device 800. In another embodiment, the decorative member 850 may be disposed on an inner or outer surface of the second. A conductive portion 851 provided as at least a portion of the decorative member 850 may be disposed near the antenna module 540. The conductive portion 851 of the decorative member 850 may have a width greater than the aforementioned width (w2) determined such that the conductive member improves the radiation performance of the antenna module 540. Therefore, the conductive portion 851 of the decorative member 850 may include, at least in part, a slit 852 formed to obtain the width (w2) for satisfying a condition for improving the radiation performance of the antenna module 540. That is, similar to the conductive member 550 in FIG. 5, the conductive portion 851 of the decorative member 850 may be formed, by adding the slit 852, to have the width (w2) satisfying a condition for improving the radiation performance of the antenna module 540.

The electronic device 800 may include, in addition to the conductive decorative member 850, a conductive support plate or a conductive bracket that is disposed in the inner space 8001 of the electronic device 800 to reinforce rigidity and has a conductive portion disposed near the antenna module 540. In this case, the conductive portion may have at least one slit enabling the conductive portion to be utilized as a conductive member for improving the radiation performance of the antenna module.

Figure 9:
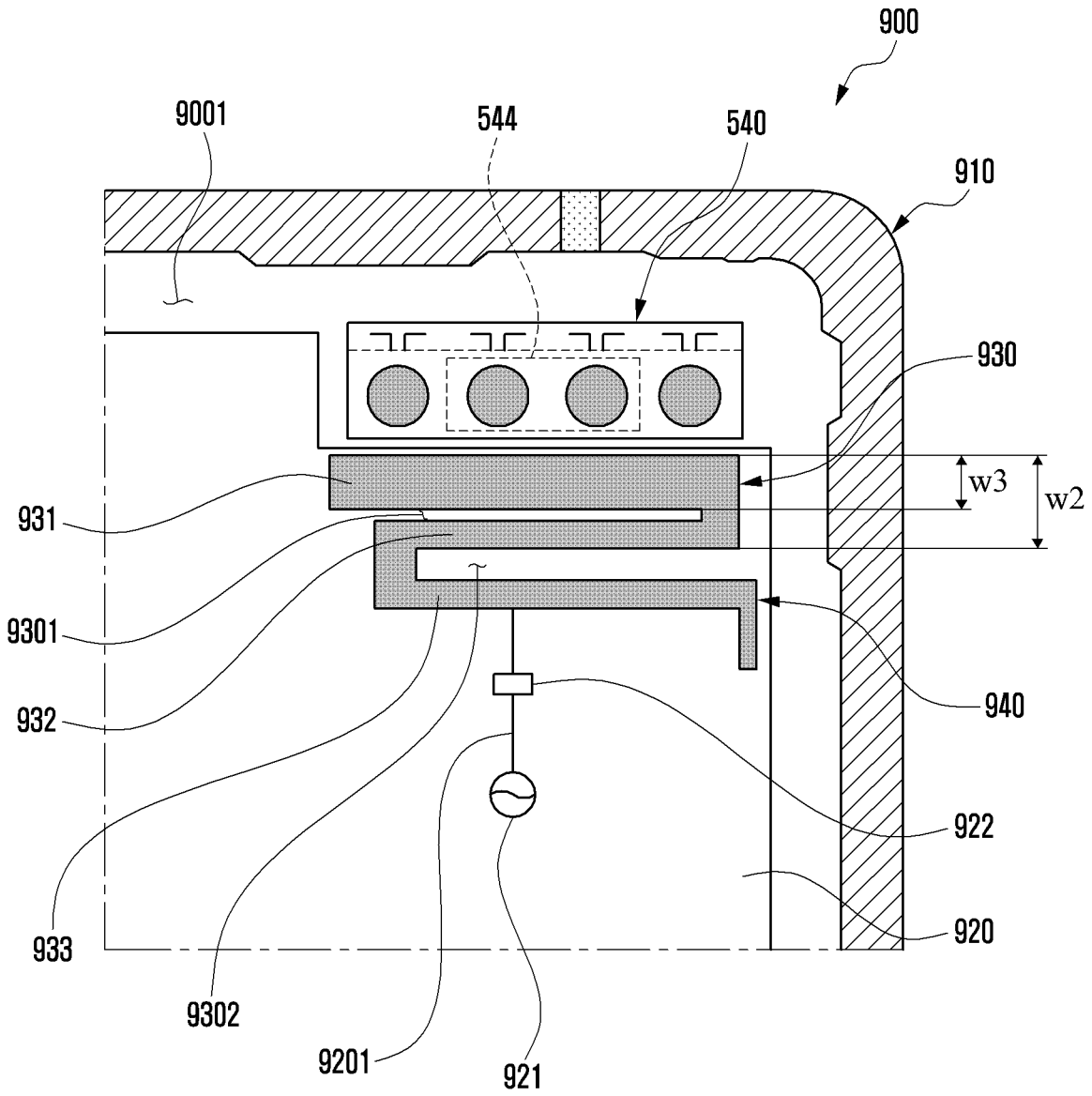
FIG. 9 illustrates an electronic device in which at least a part of a legacy antenna structure is replaced with a conductive member according to an embodiment.

FIG. 9 illustrates an electronic device 900 in which at least a part of a legacy antenna structure 930 is replaced with a conductive member according to an embodiment.

The electronic device 900 of FIG. 9 may be similar, at least in part, to the electronic device 101 of FIG. 1, the electronic device 300 of FIG. 3A, or the electronic device 500 of FIG. 5, or may include other embodiments of the electronic device.

Referring to FIG. 9, the electronic device 900 includes a housing 910 having an inner space 9001. The electronic device 900 may include the first antenna module 540 disposed at a certain position in the inner space 9001 of the housing 910. The first antenna module 540 is the substantially same as the antenna module 540 shown in FIG. 5, so that a detailed description thereof is omitted.

The electronic device 900 may include a second antenna module 940 disposed near the first antenna module 540. The first antenna module 540 may form a beam pattern in at least one specified direction in a frequency band ranging from 3 GHz to 100 GHz via a first wireless communication circuit 544.

The second antenna module 940 may include the antenna structure 930 disposed near the first antenna module 540 on a PCB 920 in the inner space 9001 of the electronic device 900, and a second wireless communication circuit 921 disposed on the PCB 920 and electrically connected to the antenna structure 930 through an electrical path 9201 (e.g., a wiring line). The second antenna module 940 may further include at least one passive element 922 (e.g., a capacitor or an inductor) disposed on the electrical path 9201 and used to shift an operating frequency band of the second antenna module 940 or to adjust bandwidth (e.g., expand bandwidth). The at least one passive element 922 may be replaced with a tunable integrated circuit. The antenna structure 930 may be disposed in the inner space 9001 of the electronic device 900 through a support member (e.g., a dielectric carrier) made of a dielectric material rather than the PCB 920. The second antenna module 940 may be a legacy antenna module, which may be configured to transmit and/or receive a radio signal in a frequency band ranging from 600 MHz to 6000 MHz through the second wireless communication circuit 921.

The antenna structure 930 may be formed of a conductive material. For example, the antenna structure 930 may include a conductive pattern formed on the PCB 920, or may include a laser direct structuring (LDS) pattern formed on an outer surface of a dielectric structure disposed in the inner space of the electronic device, not on the PCB.

The antenna structure 930 includes a first conductive portion 931, a second conductive portion 932, and a third conductive portion 933. The first conductive portion 931 is disposed at a position adjacent to the first antenna module 540. The second conductive portion 932 extends from the first conductive portion 931, is spaced apart from the first conductive portion 931 by a first slit 9301 and is disposed substantially parallel with the first conductive portion 931. The third conductive portion 933 extends from the second conductive portion 932, is spaced apart from the second conductive portion 932 by a second slit 9302 and is disposed substantially parallel with the second conductive portion 932. The width of the first slit 9301 may be formed to be smaller than the width of the second slit 9302. The third conductive portion 933 may be electrically connected to the second wireless communication circuit 921 through the electrical path 9201.

The first conductive portion 931 and/or the second conductive portion 932 may operate as a radiator of the second antenna module 940 and also operate as the above-described conductive member 550 for improving the radiation performance of the first antenna module 540. For example, when the width of the first slit 9301 is small, the first and second conductive portions 931 and 932 may be used as one conductive member having a first width (w2) with respect to the first antenna module 540. In this case, the first and second conductive portions 931 and 932 may be utilized as the conductive member operating in a first frequency band (e.g., about 28 GHz frequency band) through the second slit 9302 with respect to the first antenna module 540. For example, in the 28 GHz frequency band, the effect of the second slit 9302 for electrically separating the first and second conductive portions 931 and 932 may be small, and the first and second conductive portions 931 and 932 may operate as one conductive member electrically separated from the third conductive portion 933 by the second slit 9302. In another embodiment, when the first antenna module 540 operates in a second frequency band (e.g., about 39 GHz frequency band) higher than the first frequency band, the first conductive portion 931 may be utilized as a conductive member having a second width (w3) with respect to the first antenna module 540 through the first slit 9301.

The first conductive portion 931 and/or the second conductive portion 932 of the antenna structure 930 adjacent to the first antenna module 540 may have an appropriate size, shape or arrangement position so as to perform a function as a conductive member for improving the radiation performance of the first antenna module 540 in addition to operating smoothly in an operating frequency band of the second antenna module 940.

Embodiments of the disclosure can prevent the radiation performance of the antenna module from being degraded by disposing the conductive member near the antenna module. In addition, the conductive member may be replaced with at least a part of at least one essential structure of the electronic device, thus increasing a degree of freedom in mounting components while helping to improve the radiation characteristics of the antenna module.

As described above, an electronic device may include a housing including a first plate facing a first direction, a second facing a second direction opposite to the first direction, and a lateral member surrounding a space between the first plate and the second plate. The electronic device may also include a first antenna structure disposed to be substantially parallel with the second plate in the space, and including a substrate disposed in the space, and at least one antenna element disposed on the substrate to face at least the second plate. Further, the electronic device may include a conductive member disposed in the space and spaced apart from the at least one antenna element at a predetermined interval when the second plate is viewed from above, and a first wireless communication circuit configured to form a directional beam, at least in part, through the first antenna structure.

The first wireless communication circuit may be configured to transmit and/or receive a signal having a frequency between about 3 GHz and about 100 GHz through the first antenna structure.

The conductive member may be disposed near the substrate in parallel with a longitudinal direction of the substrate.

A length of the conductive member may be determined in a range of 0.5 to 1.5 times a length of the at least one antenna element.

A width of the conductive member may be determined in a range of 0.5 to 1.5 times a width of the at least one antenna element.

A distance between a center of the conductive member and a center of the at least one antenna element may be determined in a range of $\frac{1}{2}\lambda$ to $\lambda$.

The conductive member may include a conductive portion formed as at least a part of a conductive decorative member disposed in the space.

The conductive portion may include at least one slit formed in a direction parallel with a longitudinal direction of the substrate.

The conductive member may include a conductive portion formed as at least a part of a conductive rigid-reinforcing member disposed in the space.

The conductive portion may include at least one slit formed in a direction parallel with a longitudinal direction of the substrate.

The electronic device may further include a second antenna structure disposed near the first antenna structure and including, at least in part, a conductive portion, and a second wireless communication circuit electrically connected to the second antenna structure. The conductive member may include at least a part of the conductive portion.

The second wireless communication circuit may be configured to transmit and/or receive a signal having a frequency between about 600 MHz and about 6000 MHz through the second antenna structure.

The second antenna structure may include a conductive pattern formed on a printed circuit board disposed in the space.

The second antenna structure may include an LDS pattern formed in a dielectric structure disposed in the space.

The substrate may include a first surface facing the first direction, and a second surface facing the second direction. In addition, the first antenna structure may include a plurality of first antenna elements formed on the second surface of the substrate or disposed near the second surface in an inner space between the first and second surfaces of the substrate, and forming a beam pattern in a direction of the second plate, and a plurality of second antenna elements formed in the inner space between the first and second surfaces of the substrate, and forming a beam pattern in a direction of the lateral member.

The plurality of first antenna elements may include a plurality of conductive patches formed on the substrate and operate as a patch antenna array.

The plurality of second antenna elements may include a plurality of conductive patterns formed on the substrate and operate as a dipole antenna array.

The electronic device may further include a display disposed in the space to be visible from outside through at least a part of the first plate.

The term "module" may include a unit implemented in hardware, software, or firmware, and may interchangeably be used with other terms "logic", "logic block", "part", or "circuitry". A module may be a single integral component, or a minimum unit or part thereof, adapted to perform one or more functions, and may be implemented in a form of an application-specific integrated circuit (ASIC).

Various embodiments as set forth herein may be implemented as software including one or more instructions that are stored in a storage medium that is readable by a machine. For example, a processor of the machine may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. The expression "non-transitory" indicates that the storage medium is a tangible device, and does not include a signal, but this expression does not differentiate between where data is semi-permanently or temporarily stored in the storage medium.

A method according to an embodiment of the disclosure may be included and provided in a computer program product that may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices directly. If distributed online, at least part of the computer program product may be temporarily generated or at least temporarily stored in the machine-readable storage medium, such as memory of the manufacturer's server, a server of the application store, or a relay server.

Each component of the above-described components may include a single entity or multiple entities. One or more of the above-described components may be omitted, or one or more other components may be added. Alternatively or additionally, a plurality of components may be integrated into a single component. In such a case, the integrated component may still perform one or more functions of each of the plurality of components in the same or similar manner as they are performed by a corresponding one of the plurality of components before the integration. Operations performed by the module, the program, or another component may be performed sequentially, in parallel, repeatedly, or heuristically, one or more of the operations may be executed in a different order or omitted, or one or more other operations may be added.

While the disclosure has been particularly shown and described with reference to certain embodiments thereof, it will be understood by those skilled in the art that various changes in form and details may be made therein without departing from the scope of the subject matter as defined by the appended claims and their equivalents.

What is claimed is:

1. An electronic device, comprising:

a housing including a first plate facing a first direction, a second plate facing a second direction opposite to the first direction, and a lateral member surrounding a space between the first plate and the second plate;

a first antenna structure disposed in parallel with the second plate in the space, and including:

a substrate disposed in the space; and at least one antenna element disposed on the substrate to face the second plate;

a second antenna structure disposed near the first antenna structure, and including a conductive portion positioned on a printed circuit board disposed in the space of the housing, wherein the conductive portion includes:

a first conductive portion disposed at a position adjacent to the first antenna structure and disposed near the substrate, in parallel with a longitudinal direction of the substrate, a second conductive portion extending from the first conductive portion, spaced apart from the first conductive portion by a first slit, and being disposed in parallel with the first conductive portion, and a third conductive portion extending from the second conductive portion, spaced apart from the second conductive portion by a second slit, and being disposed in parallel with the second conductive portion;

a first wireless communication circuit configured to form a directional beam, at least in part, through the first antenna structure; and a second wireless communication circuit electrically connected to the third conductive portion, wherein a length of the first conductive portion is determined to be in a range of 0.5 to 1.5 times a length of the at least one antenna element.

2. The electronic device of claim 1, wherein the first wireless communication circuit is configured to transmit and/or receive a signal having a frequency between about 3 gigahertz (GHz) and about 100 GHz through the first antenna structure.

3. The electronic device of claim 1, wherein the second wireless communication circuit is configured to transmit or receive a signal having a frequency between about 600 megahertz (MHz) and about 6000 MHz through the second antenna structure.

4. The electronic device of claim 1, wherein the conductive portion second antenna structure includes a conductive pattern formed on a-the printed circuit board disposed in the space.

5. The electronic device of claim 1, wherein the substrate includes:

a first surface facing the first direction; and a second surface facing the second direction, and wherein the first antenna structure includes:

a plurality of first antenna elements formed on the second surface of the substrate or disposed near the second surface in an inner space between the first and second surfaces of the substrate, and forming a beam pattern in a direction of the second plate; and a plurality of second antenna elements formed in the inner space between the first and second surfaces of the substrate and forming a beam pattern in a direction of the lateral member.

6. The electronic device of claim 5, wherein the plurality of first antenna elements includes a plurality of conductive patches formed on the substrate and operating as a patch antenna array.

7. The electronic device of claim 5, wherein the plurality of second antenna elements includes a plurality of conductive patterns formed on the substrate and operating as a dipole antenna array.

8. The electronic device of claim 1, further comprising a display disposed in the space to be visible from outside the electronic device through at least a part of the first plate.

9. The electronic device of claim 1, wherein a width of the first conductive member is determined in a range of 0.5 to 1.5 times a width of the at least one antenna element.

10. The electronic device of claim 1, wherein a distance between a center of the first conductive portion and a center of the at least one antenna element is determined in a range of $\frac{1}{2}\lambda$ to $\lambda$.

* * * * *